United States Patent [19]

Geels

[11] Patent Number: 4,643,816

[45] Date of Patent: Feb. 17, 1987

[54] PLATING USING A NON-CONDUCTIVE SHROUD AND A FALSE BOTTOM

[75] Inventor: Daniel P. Geels, Dayton, Ohio

[73] Assignee: Burlington Industries, Inc., Greensboro, N.C.

[21] Appl. No.: 732,259

[22] Filed: May 9, 1985

[51] Int. Cl.[4] ..... C25D 17/00

[52] U.S. Cl. ..... 204/228

[58] Field of Search ..... 204/228, 229, 231, DIG. 7

[56] References Cited

U.S. PATENT DOCUMENTS

| | | | |
|---|---|---|---|
| 916,033 | 3/1909 | Schmidt | 204/DIG. 7 |
| 2,859,166 | 11/1958 | Grigger | 204/279 |
| 3,023,154 | 2/1962 | Hough et al. | 204/242 |
| 3,437,578 | 4/1969 | Gibbs | 204/231 |
| 3,616,287 | 10/1971 | Draghicescu | 204/25 |
| 3,729,390 | 4/1973 | Mathre et al. | 204/28 |
| 3,862,891 | 1/1975 | Smith | 204/DIG. 7 |
| 3,880,725 | 4/1975 | Van Raalte | 204/231 |
| 4,077,864 | 3/1978 | Vanderveer et al. | 204/285 |
| 4,160,713 | 7/1979 | Matsuzaki et al. | 204/180 P |
| 4,259,166 | 3/1981 | Whitehurst | 204/279 |
| 4,272,351 | 6/1981 | Kotani et al. | 204/202 |
| 4,306,952 | 12/1981 | Jansen | 204/231 |
| 4,323,433 | 4/1982 | Loch | 204/56 R |

FOREIGN PATENT DOCUMENTS 496113 11/1938 United Kingdom ..... 204/231

*Primary Examiner*—T. M. Tufariello

*Attorney, Agent, or Firm*—Nixon & Vanderhye

[57] ABSTRACT

A shroud of electrically non-conductive material and a false anode are used in a plating operation to provide uniform electrodeposition of material on a workpiece. The plating apparatus includes a cell having a bath with the material to be electrodeposited (such as nickel phosphorus, to be deposited as an amorphous alloy) on the workpiece. An anode is disposed in the cell, and the workpiece is immersed in the cell and acts as the cathode. A voltage is applied across the cathode and the anode. The shroud comprises a substantially quadrate (e.g. rectangular) box of electrically insulating material having first and second open ends, and closed sidewalls. A collar is formed at the first open end and is adapted to be connected to the cathode-workpiece, and a like shroud on the opposite side of the cathode-workpiece. A screen of electrically conductive material is mounted at the second end of each shroud. Holes are formed in one sidewall of the shroud, and the bath liquid is circulated through the holes into uniform contact with the cathode-workpiece. A bus-bar is received by one of the shroud collars.

13 Claims, 5 Drawing Figures

PLATING USING A NON-CONDUCTIVE SHROUD AND A FALSE BOTTOM

BACKGROUND AND SUMMARY OF THE INVENTION

In the practice of electroplating procedures, it is usually important to make sure that the material plated on the workpiece is plated uniformly. For some specific applications, uniform plating is particularly important, such as in the plating of orifice plates with an amorphous nickel phosphorus alloy, such as disclosed in copending application Ser. No. 464,101 filed Feb. 4, 1983.

In the art it is recognized that electroplating procedures may be modified by the use of a non-conductive shroud, and false anodes have been known for the purpose of leveling out current density variations while electroplating. However, it has been found according to the present invention that if a non-conductive shroud and a false anode are used in combination, platings having the desired uniformity are produced, whereas they are not necessarily produced using one or the other alone.

According to the present invention, a particular non-conductive shroud and a false anode particularly associated with the non-conductive shroud are provided so that plating of a workpiece can be accomplished with uniform electrodeposition of material (for example amorphous nickel phosphorus alloy) on the workpiece. The increased uniformity is provided by providing the non-conductive shroud so that it defines an opening adjacent the cathode-workpiece between the cathode-workpiece and the anode of the plating apparatus cell. The shroud prevents bulging of current lines beyond the opening defined thereby, causing a more desirable distribution of current density on the cathode-workpiece. The false anode is preferably connected to an open end of the shroud spaced from the cathode-workpiece, and comprises a screen of electrically conductive material which is not connected to a current source other than the electrolyte. The false anode provides an area of uniform potential at the open end of the shroud. In order to overcome the tendency for the bath liquid to stagnate within the area defined by the shroud, the bath liquid is circulated through openings formed in a closed wall of the shroud, so as to be uniformly moved over the cathode-workpiece.

According to one aspect of the present invention, there are provided: A cell including a bath having material therein to be electrodeposited on the workpiece. An anode disposed in the cell. A source of electrical current operatively connected to the anode and to a workpiece to be plated so that the workpiece acts as a cathode. Electrically insulating material shroud means operatively connected to the workpiece and defining an area between the anode and the workpiece for preventing bulging of current lines beyond the area defined thereby. And, conductive material means physically disposed between the anode and the cathode adjacent the area defined by the shroud means providing an area of uniform potential. The shroud preferably comprises a substantially quadrate (e.g. rectangular) box of electrically insulating material having first and second open ends and closed sidewalls. The electrically conductive means preferably comprises a screen mounted to the second open end of the box. A plurality of holes are defined in one of the closed sidewalls of the box, and nozzles circulate the bath liquid through the holes uniformly over the cathode-workpiece. For uniformly plating opposed faces of a workpiece, preferably two anodes, shrouds, and false anodes are provided, and the cathode-workpiece is sandwiched between the shrouds.

The invention also relates to a particular generally quadrate (e.g. rectangular) shroud of electrically insulating material which includes a generally quadrate (e.g. rectangular) box having first and second open ends, and closed sidewalls. A collar is operatively mounted to the box at the first open end thereof, and is adapted to engage the cathode-workpiece, while the false anode is mounted to the second open end of the box. A plurality of openings are formed in one of the sidewalls for the introduction of the circulating bath liquid. The collar preferably includes means for receiving a bus-bar therein, for operative connection to the cathode-workpiece.

The invention also relates to a method of uniformly plating material onto a workpiece, comprising the steps of: (a) providing a cell with a bath which includes the material to be plated; (b) immersing the workpiece in the bath; (c) providing an anode in the bath; (d) electrically connecting the anode to a source of electrical current, and supplying electrical current to the bath so that the workpiece acts as a cathode; (e) preventing bulging of current lines beyond an area defined adjacent the cathode-workpiece; and (f) maintaining a surface other than the anode substantially equidistant from the workpiece at a substantially uniform electrical potential. Step (e) is practiced by providing a shroud of electrically insulating material defining an area adjacent the cathode-workpiece, between it and the anode. Step (f) is accomplished by providing a false anode, such as an electrically conductive material screen mounted on an open end of the shroud. Bath liquid preferably uniformly circulates around the cathode-workpiece. The method is useful with almost all types of electroplating, but is particularly applicable where very uniform electroplating must be provided, such as in the electrodeposition of amorphous nickel phosphorus alloys on substrates.

It is the primary object of the present invention to provide a simple and effective apparatus and method for the uniform electroplating of workpieces. This and other objects of the invention will become clear from an inspection of the detailed description of the invention, and from the appended claims.

DETAILED DESCRIPTION OF THE DRAWINGS

Figure 1:
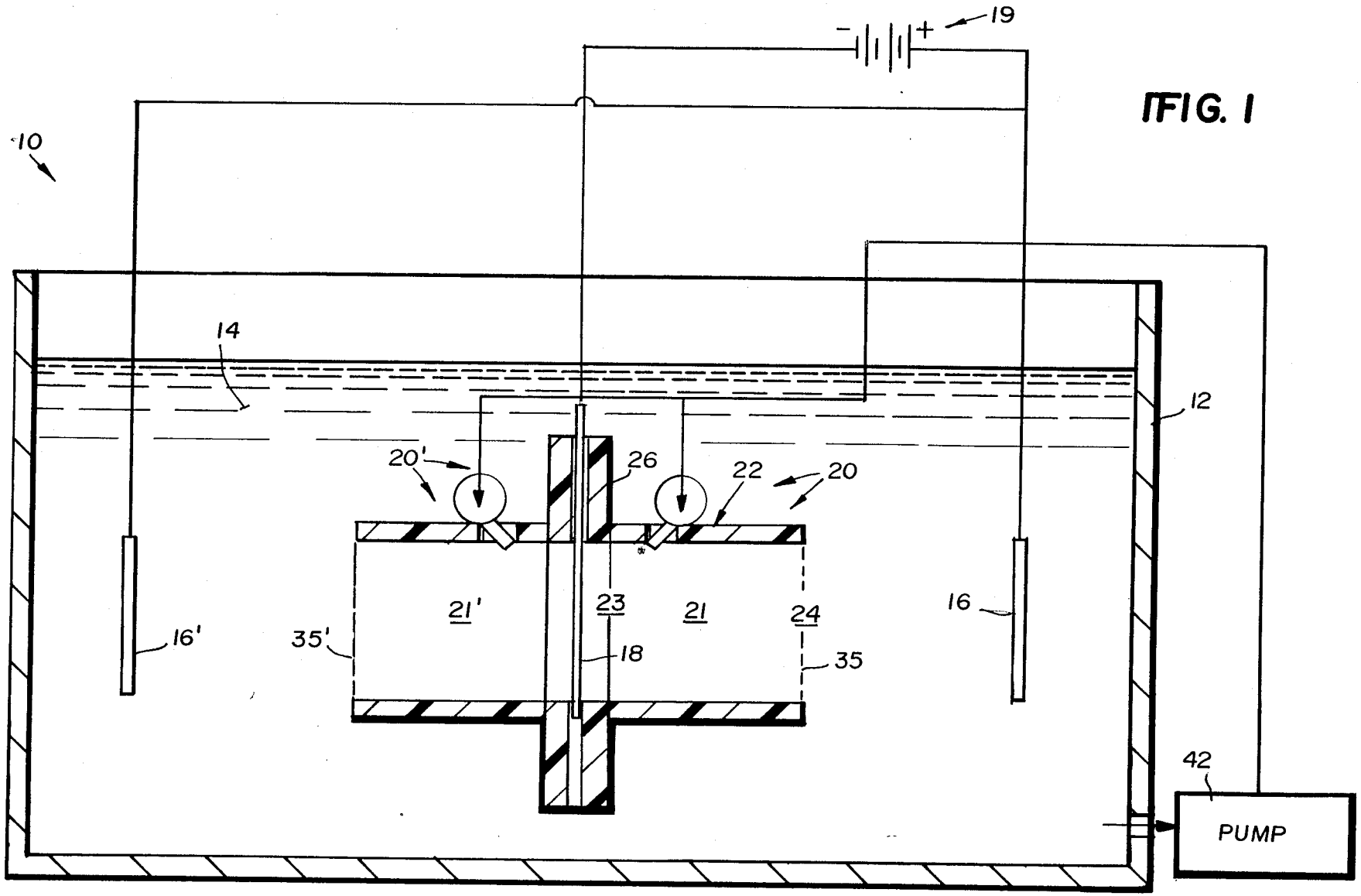
FIG. 1 is a side schematic cross-sectional view of one form of exemplary electroplating apparatus according to the present invention.

Electroplating apparatus according to the present invention is shown generally by reference numeral 10 in FIG. 1. The plating apparatus includes a cell defined by a container 12 with a liquid bath 14 within the container 12. The bath 14 contains a material to be electroplated onto the workpiece. For example, where an amorphous nickel phosphorus alloy is to be electrodeposited on a conductive material substrate, such as an orifice plate, the bath 14 includes components containing nickel and phosphorus, such as $NiCl_2$ and $H_3PO_3$. For example see copending application Ser. No. 464,101 filed Feb. 4, 1983, allowed Dec. 10, 1984, the entire disclosure of which is incorporated herein by reference.

Immersed within the bath 14 are one or more anodes 16, 16'. A cathode-workpiece, the object to be plated, 18 is also immersed within the bath 14. A source of electric current, such as a battery 19 is operatively connected to the anodes 16, 16' and the cathode 18.

Figure 3:
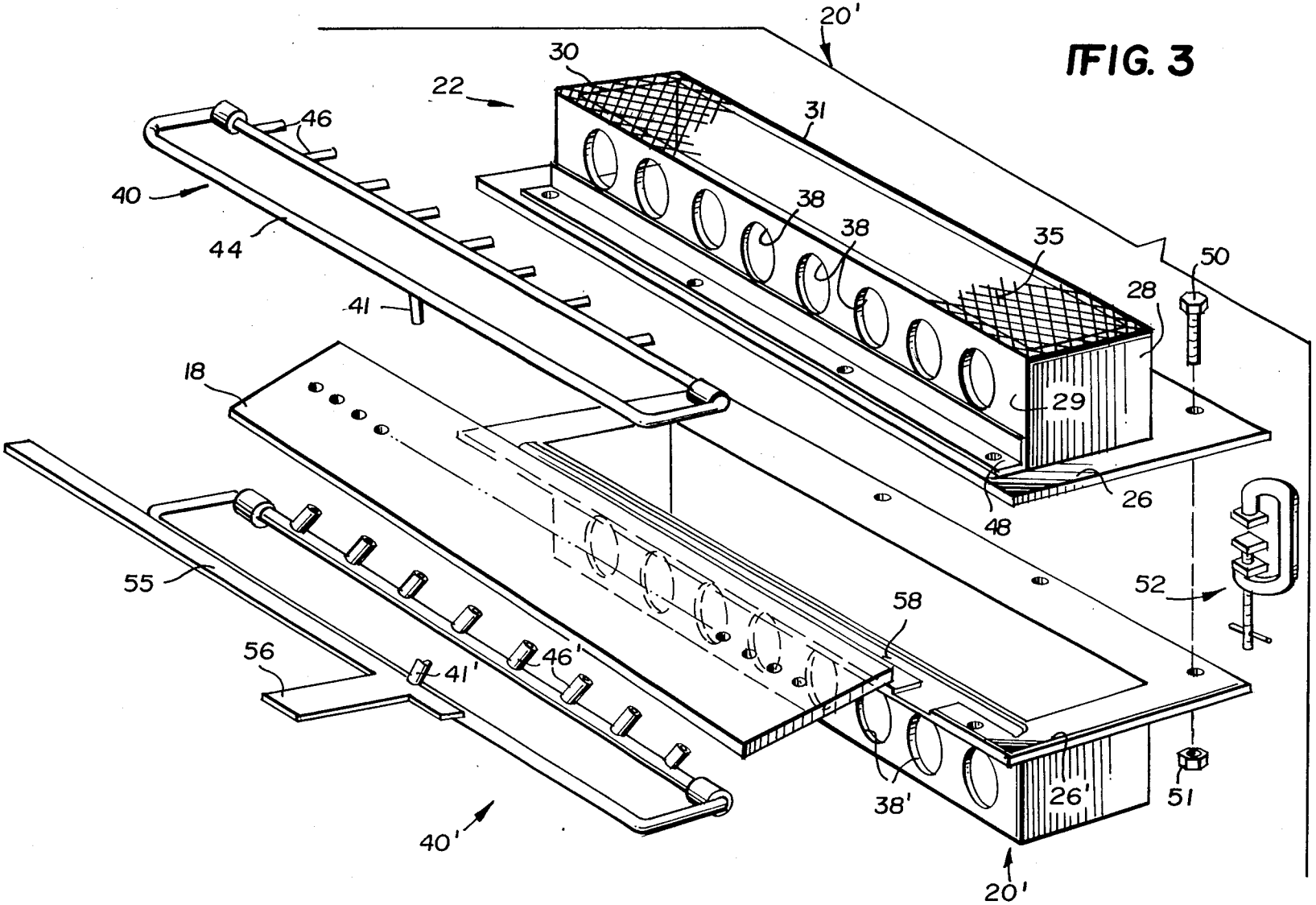
FIG. 3 is an exploded perspective view of important components of the exemplary electroplating apparatus according to the invention.

According to the present invention, a shroud means 20 is provided for defining an area 21 (21') adjacent the cathode-workpiece 18, between the cathode-workpiece 18 and the anode(s) 16, (16'), to prevent bulging of current lines beyond the area 21 (or 21') defined thereby. Not only do the current lines not bulge beyond areas 21, 21', but also they are maintained substantially parallel within those areas. The shroud means 20 preferably comprises a generally quadrate (e.g. rectangular) box 22 having first and second open ends 23, 24, respectively. Shroud means 20 is made of a non-conductive material, preferably polypropylene plastic. The first open end 23 preferably is defined by a collar 26 which is connected to the box 22 at that point. The sidewalls 28, 30 and 31 of the box 22 are closed, as shown in FIG. 3. Side-wall 29 is likewise closed, but is provided with openings 38.

According to the present invention there also is provided a false anode 35 disposed between the anode 16 and the cathode-workpiece 18. The false anode 35 may comprise any suitable form of electrically conductive material that is physically disposed between the anode 16 and the cathode-workpiece 18, but is unconnected to the current source 19 except through the liquid of the bath 14. In the preferred form illustrated in FIGS. 2 and 3, the false anode 35 comprises a screen of electrically conductive material, such as platinized titanium, tantalum, platinum, gold, or other inert, conductive material made into wire, and then screen. This screen 35 is affixed directly to the second open end 24 of the box 22. The false anode 35 provides a surface over which the electrical potential is substantially uniform, making the potential difference between points on the cathode-workpiece and points on the false anode as uniform as possible. Thus, the current between the false anode and the cathode-workpiece is made to be more uniform.

Figure 4:
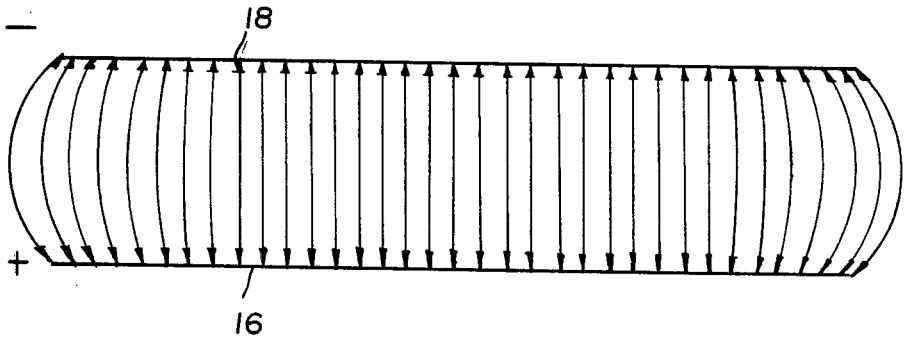
FIGS. 4 and 5 are schematic representations of current lines between an anode and a cathode in a cell having no shroud (FIG. 4), and having a shroud and false anode according to the invention (FIG. 5).
Figure 5:
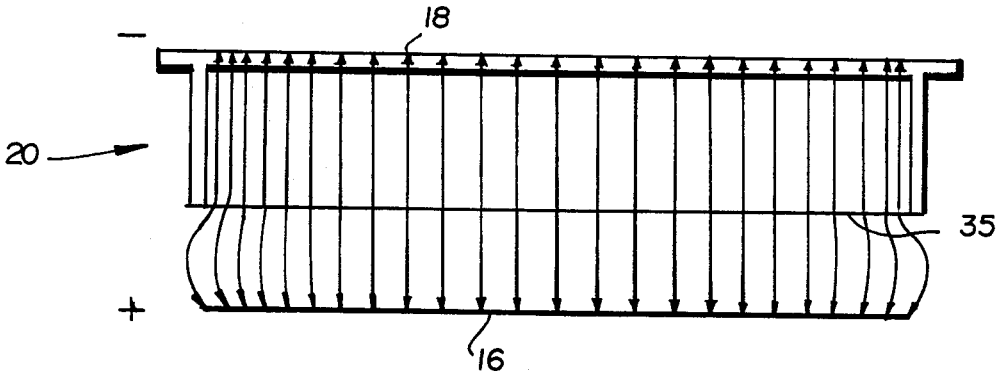

The effect that the shroud and false anode have on current lines extending between the anode and cathode is schematically illustrated in FIG. 4 and 5. Note the high degree of bulging of the current lines in FIG. 4 when no shroud or false anode is used, compared to the lack of bulging adjacent the cathode in FIG. 5 when the shroud 20 and false anode 35 are present.

Figure 2:
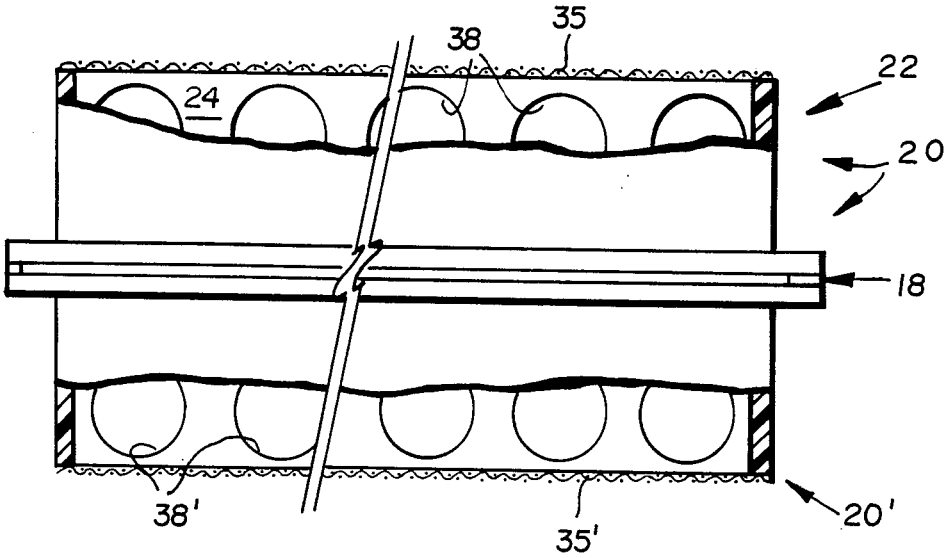
FIG. 2 is a bottom view, partly in elevation and partly in cross-section, of an exemplary assembly of non-conductive shrouds, false anodes, and cathode-workpiece according to the present invention.

As illustrated in FIGS. 1–3, it is preferred that the apparatus 10 according to the invention comprise dual sets of components associated with a common cathode-workpiece 18, to facilitate uniform plating to both sides thereof. This is particularly important where the cathode-workpiece 18 is something that must be plated uniformly on opposite sides thereof, such as jet dyeing orifice plates as illustrated by the reference numeral 18 in FIG. 3. Thus a second anode 16' will be provided, a second shroud means 20', and a second false anode 35'. For the second set of components the same reference numerals are used as for the first set except followed by a "'".

While the structure heretofore described is extremely effective in providing uniform current density, and thus uniform electrodeposition of material on the cathode-workpiece, because of the particular construction of the shroud 20 and the screen 35, circulation of the bath liquid (electrolyte) adjacent the cathode-workpiece 18 is not as good as desired. The bath liquid has a tendency to stagnate within the area defined by the shroud 20. In order to overcome this, means are provided for circulating liquid generally uniformly around the cathode-workpiece 18. Such circulation means preferably take the form of a plurality of openings 38 formed in the sidewall 29 of the box 22. The circulation means also comprise a spray manifold 40 including a pipe 41 adapted to be connected to a pump 42 to withdraw electrolyte from container 12, a manifold pipe 44, and a plurality of sparging nozzles 46, one nozzle associated with each opening 38. The openings 38 and/or nozzles 46 are slanted so as to provide proper circulation of liquid around the cathode-workpiece 18. The circulation liquid can easily flow out through the screen 35, but if necessary or desirable other openings can be provided in other walls of the box 22 to facilitate circulation. Note that the manifold 40 may be mounted on a support structure directly on the collar 26 and box 22, such as the angle portion 48 illustrated in FIG. 3. A manifold 40 and angle portion 48 preferably are also of non-conductive material, such as the same polypropylene plastic as the shroud 20. The openings 38 should be as small as practicable so that the nozzles 46 can be located as close together as possible to assure that the sparging electrolyte contacts the cathode-workpiece uniformly. Wide-spacing of sparging nozzles may introduce non-uniformity in the plating product causing variations in electrolyte freshness.

In the preferred embodiment, the cathode-workpiece 18 is sandwiched between the shrouds 20, 20', and the shrouds 20, 20' may be held together with the cathode-workpiece 18 clamped therebetween by any suitable means, such as nuts and bolts (see exemplary bolt 50 and cooperating nut 51 in FIG. 3), conventional clamps (see a schematic illustration of clamp 52 in FIG. 3) etc. Also, in order to conveniently provide electrical interconnection of the cathode-workpiece to the current source 19, or the like, a copper bus-bar 55 or the like may be provided. The bus-bar 55 includes upwardly extending tab 56, and a cut-out 58 is provided in one or both of the collars 26', 26 (see collar 26' in FIG. 3) for receipt of the bus-bar 55 with upstanding tab 56. The cathode-workpiece 18 is then affixed in intimate contact with the busbar 55 when the shrouds are clamped together.

In the practice of the method of uniformly electroplating a workpiece 18 according to the present invention, the following steps are practiced: (a) a bath 14 is provided having the material to be plated (such as nickel and phosphorus) in the bath; (b) a workpiece 18 is immersed in the bath 14; (c) an anode 16 is provided immersed in the bath 14; (d) the anode 16 and the workpiece 18 are operatively connected to a source of current supply 19 so as to provide current thereto, with the workpiece 18 acting as a cathode; (e) bulging of current lines adjacent the cathode-workpiece 18 is prevented, preferably by providing a shroud 20 of electrically insulating material defining an area adjacent and around the cathode-workpiece 18 and between it and the anode 16; and (f) a surface substantially uniformly equidistant from the cathode-workpiece is maintained at a substantially uniform electrical potential by providing a false anode 35 of electrically conductive material between the cathode-workpiece 18 and the anode 16. The method also preferably comprises the steps of pumping electrolyte via pump 42 to manifolds 40, 40', and associated nozzles 46, 46', for causing the bath 14 electrolyte to circulate through openings 38, 38' into uniform contact with the cathode-workpiece 18.

It will thus be seen that according to the present invention a method and apparatus have been provided for facilitating and/or effecting uniform electroplating of a cathode-workpiece. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods. In particular, while a specific apparatus for plating planar cathode-workpieces has been described, cathode-workpieces of different geometrics can be plated with the invention by making suitable adjustments in shroud and false anode geometrics. Such adjustments will be apparent to those of ordinary skill in the plating art.

What is claimed is:

1. Plating apparatus for uniform electrodeposition of material onto a workpiece, comprising:

a cell including a bath having material therein to be electrodeposited on the workpiece;

an anode disposed in said cell;

a source of electrical current operatively connected to said anode, and to a workpiece to be plated so that the workpiece acts as a cathode;

electrically insulating material shoud means operatively connected to the workpiece and defining an area between the anode and the workpiece for preventing bulging of current lines beyond the area defined thereby; and conductive material means physically disposed between the anode and the cathode adjacent the area defined by such shroud means, unconnected to the source of electrical current except through the bath, and for defining an equipotential surface.

2. Apparatus as recited in claim 1 wherein said conductive material means is mounted on said shroud means.

3. Apparatus as recited in claim 2 further comprising means for circulating bath liquid within the area defined by such shroud means to uniformly circulate bath liquid around the cathode.

4. Apparatus as recited in claim 2 wherein said conductive material means comprises a screen of electrically conductive material affixed to said shroud means.

5. Apparatus as recited in claim 1 wherein two anodes are provided connected to said electric current supply means, and two electrically insulating material shroud means are provided, and two conductive material means are provided; and wherein the workpiece is mounted between and to the shroud means, and wherein said electrically conductive material means are mounted to the shroud means with one of said electrically conductive material means disposed between the workpiece and each of said anodes.

6. Apparatus as recited in claim 5 wherein each of said shroud means comprises a quadrate box of electrically insulating material having first and second open ends, and closed side walls; a collar operatively connected to said first end of said box and engaging the workpiece; and said electrically conductive material means are mounted to said second end of said box.

7. Apparatus as recited in claim 6 wherein each of said boxes has means defining a plurality of openings in one sidewall thereof; and circulating means for circulating bath liquid into uniform contact with the workpiece, said circulating means including a plurality of tubes operatively associated with the openings in the sidewall of at least one of said shrouds.

8. Apparatus as recited in claim 6 wherein each of said conductive material means comprises a screen of electrically conductive material covering said second end of a shroud box with which it is associated.

9. Apparatus as recited in claim 1 further comprising means for circulating bath liquid into uniform contact with the workpiece through said shroud means.

10. Apparatus as recited in claim 9 wherein said shroud means comprises a quadrate box of electrically insulating material having first and second open ends, and closed sidewalls, and wherein said box has means defining a plurality of openings in one sidewall thereof, said circulating means for circulating bath liquid through said openings in said sidewall.

11. Apparatus as recited in claim 10 wherein said circulating means includes a plurality of tubes operatively associated with said plurality of openings, and for directing recirculated liquid toward said cathode-workpiece.

12. Apparatus as recited in claim 11 wherein said shroud means further comprises a collar operatively connected to said first end of said quadrate box and engaging the workpiece, and wherein said electrically conductive material means is mounted to said second end of said box.

13. Apparatus as recited in claim 12 wherein said conductive material means comprises a screen of electrically conductive material covering said second end of said quadrate box.

* * * * *